United States Patent [19]

Kasai

[11] Patent Number: 4,793,031

[45] Date of Patent: Dec. 27, 1988

[54] STRAP FASTENER

[75] Inventor: Kazumi Kasai, Namerikawa, Japan

[73] Assignee: Yoshida Kogyo K. K., Tokyo, Japan

[21] Appl. No.: 98,943

[22] Filed: Sep. 21, 1987

[30] Foreign Application Priority Data

Sep. 19, 1986 [JP] Japan ..... 61-143679[U]
Dec. 5, 1986 [JP] Japan ..... 61-187821[U]

[51] Int. Cl.[4] ..... A44B 11/25
[52] U.S. Cl. ..... 24/324; 24/623
[58] Field of Search ..... 24/324, 297, 458, 454, 24/482, 621, 622, 623; 411/508, 509

[56] References Cited

U.S. PATENT DOCUMENTS

| | | | |
|---|---|---|---|
| 1,237,201 | 8/1917 | Green, Jr. | 24/623 |
| 1,503,445 | 7/1924 | Harrison | 24/324 |
| 1,696,156 | 12/1928 | Fenton | 24/623 |
| 1,696,586 | 12/1928 | Simons | 24/324 |
| 1,904,055 | 4/1933 | King | 24/324 |
| 2,486,652 | 11/1949 | Huelster | 24/324 |
| 3,237,257 | 3/1966 | Forsberg | 24/324 |
| 3,406,431 | 10/1968 | Armstrong et al. | 24/297 |
| 3,538,554 | 11/1970 | Ford | 24/324 |

FOREIGN PATENT DOCUMENTS

| | | | |
|---|---|---|---|
| 0835357 | 3/1952 | Fed. Rep. of Germany | 24/324 |

*Primary Examiner*—Victor N. Sakran
*Attorney, Agent, or Firm*—Hill, Van Santen, Steadman & Simpson

[57] ABSTRACT

A strap fastener includes a fastener body on which a strap is retained, and a socket member adapted to be mounted on the fabric of a bag to retain the fastener body for connecting the strap to the bag. The fastener body has a plug with an enlarged head snappingly receivable in a stepped bore formed in the socket member. The fastener body is rotatable about the axis of the plug with respect to the socket member. With this construction, the strap is connected to the bag with utmost ease and can be adjusted in a desired posture to suit with the physical characteristics of the user.

5 Claims, 10 Drawing Sheets

STRAP FASTENER

BACKGROUND OF THE INVENTION

1. Field of the Invention:

The present invention relates to a strap fastener for use on shoulder bags, rucksacks, school knapsacks or other bags for connecting the end of a belt or strap to the body of a bag.

2. Prior Art:

Straps on knapsacks in common use are secured at their opposite ends in place by sewn seams or rivets via suitable covering tabs as illustrated in FIG. 18 of the accompanying drawings in which the knapsack is indicated by K, the strap by S and the tabs by T. With the straps thus permanently secured to the fabric or leather web of the knapsacks, it is literally difficult to replace the straps per se when worn or damaged without tearing the tabs off, demanding purchase of a new whole knapsack. The prior art strapped knapsack has a further drawback in that because they are fixedly connected, the straps would be swerved to the sides if worn by a wide-shouldered person as indicated by phantom lines in FIG. 18 or would otherwise fail to fit comfortably to wearers of different constitution.

SUMMARY OF THE INVENTION

It is therefore the primary object of the present invention to provide means for eliminating the foregoing difficulties of the prior art and to this end, more specifically to provide a strap fastener which will enable removal of worn or damaged straps and attachment of new counterparts with utmost ease.

Another object of the invention is to provide a strap fastener which will enable adjustment of the straps on for example a knapsack to fit different physical characteristics of the users.

According to the invention, a strap fastener includes a socket member adapted to be mounted on the fabric of a bag, and a fastener body having means for retaining a strap, and a plug projecting from the back of the fastener body. The plug includes an enlarged head snappingly received in a stepped bore in the socket member to couple the fastener body with the socket member. The fastener body in coupled condition is rotatable about the axis of the plug with respect to the socket member.

The fastener body may have a projection disposed adjacent to the plug and receivable in an elongate groove formed in the socket member to extend arcuately about the axis of the stepped bore to a limited angular extent. The socket member may be attached to the fabric of the bag by means of a mounting plate disposed on the fabric opposite to the socket member. With the mounting plate thus provided, the fastener body undergoes smaller frictional resistance imposed by the mounting plate than by the fabric of the bag when the fastener body is angularly displaced with respect to the socket member.

These and other objects and features of the invention will be better understood from the following detailed description taken in connection with the accompanying drawings, in which like reference numerals are taken to refer to like or corresponding parts throughout the several views.

DETAILED DESCRIPTION OF THE INVENTION

Figure 1:
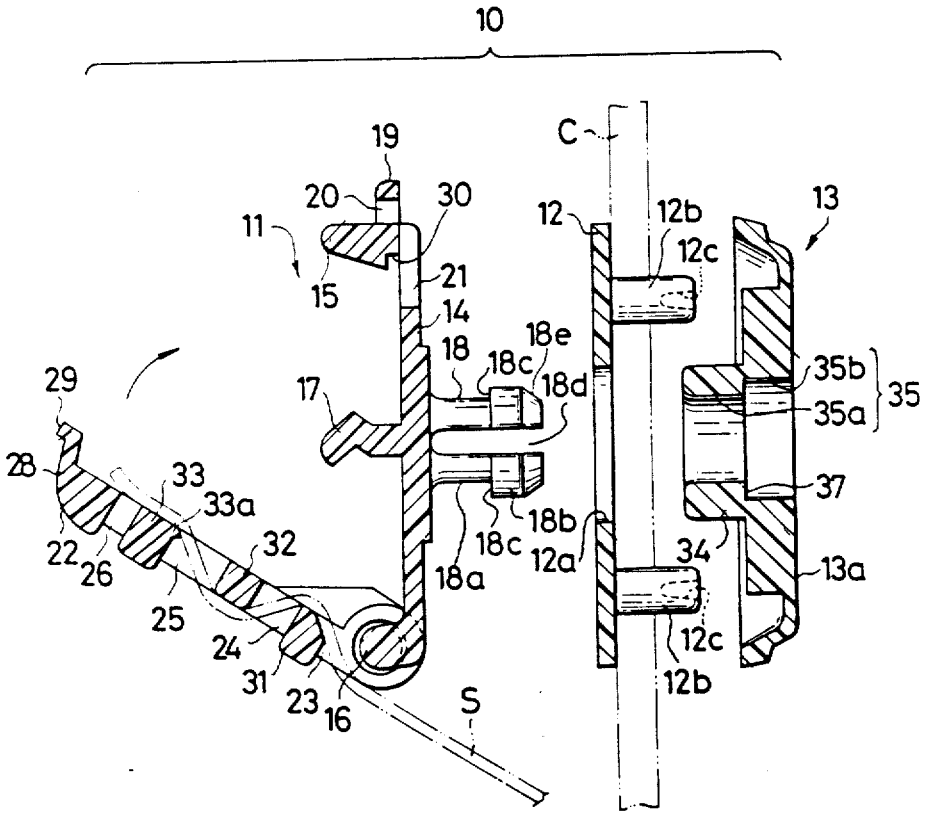
FIG. 1 is an exploded cross-sectional view of a strap fastener embodying the present invention.
Figure 2:
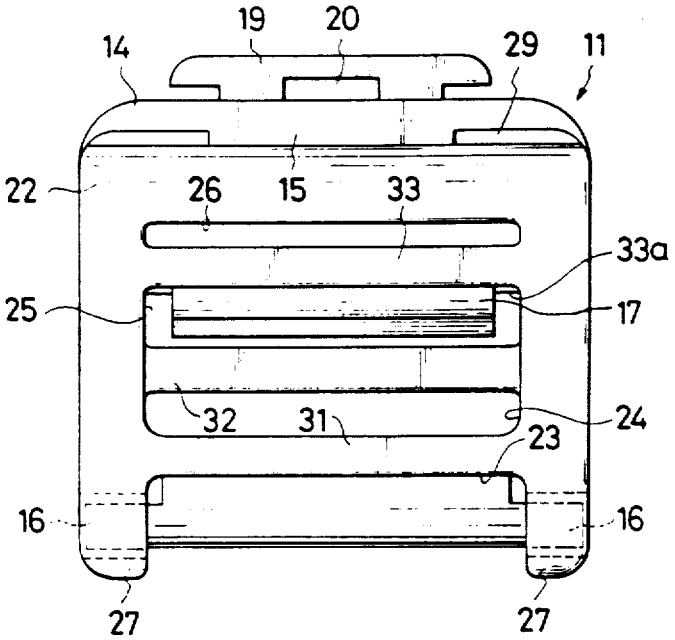
FIG. 2 is a front elevational view of a body of the strap fastener shown in FIG. 1.

Referring now to the drawings and FIG. 1 in particular, there is shown a strap fastener 10 which comprises a fastener body 11, a mounting plate 12 and a socket member 13 all molded of synthetic resin. The fastener body 11 includes a base plate 14 having a laterally outwardly extending lug 15 at one or its upper end, a pair of co-axial pins 16 at the other or its lower end, a laterally outwardly extending locking prong 17 intermediate between the lug 15 and the pin 16, and a laterally inwardly extending plug 18 opposite to the prong 17. A flange 19 having a slit 20 extends upwardly from the lug 15. The base plate 14 is provided adjacent to the lug 15 with a laterally elongated slot 21 so that the upper end portion of the base plate 14 posesses a certain degree of resiliency which is large enough to enable the lug 15 to tilt about its distal end upwardly away from the prong 17.

Figure 3:
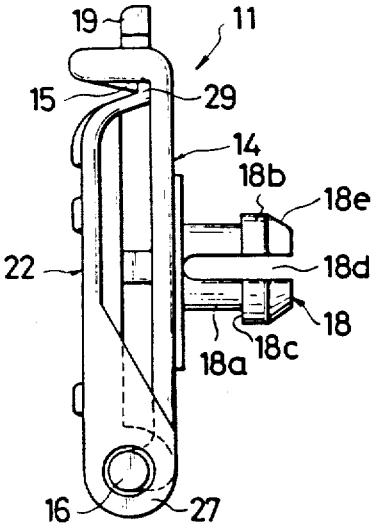
FIG. 3 is a right side view of FIG. 2.

The fastener body 11 further includes a cover plate 22 having a plurality of laterally elongated openings 23, 24, 25, 26 for the passage therethrough of a strap S, a pair of apertured lower flange portions 27 pivotally connected to the respective pins 16 of the base plate 14, and an upper flange portion 28 having a locking projection 29 engageable in complimentarily shaped recess 30 formed in the lower surface of the lug 15. The first opening 23 is defined between the flanged portions 27 and a first cross bar 31; the second opening 24 between the first cross bar 31 and a second cross bar 32; the third opening 25 between the second cross bar 32 and a third cross bar 33; and the fourth opening 26 between the third cross bar 33 and the upper flange portion 28. The second cross bar 32 is slightly off-set from the common upper plane of the cover plate 22 so as to make the strap S lie substantially flush with the upper surface of the cover 22. The third cross bar 33 has a longitudinal locking ridge 33*a* extending along its rear edge and projecting into the third opening 25. With the strap S passed through any of the openings 23–26, the cover plate 22 is rotated about the pins 16 in the direction of the arrow into coupling engagement with the base plate 14 as better shown in FIG. 3 when the locking projection 29 is snapped into the recess 30 to hold the cover 22 and the plate 14 retentively together, while the locking prong 17 enters into the third opening 25 and holds the strap S immovably against the side wall of the third cross bar 33. In this instance, the locking ridge 33*a* on the third cross bar 33 bites into the web of the strap S.

Figure 4:
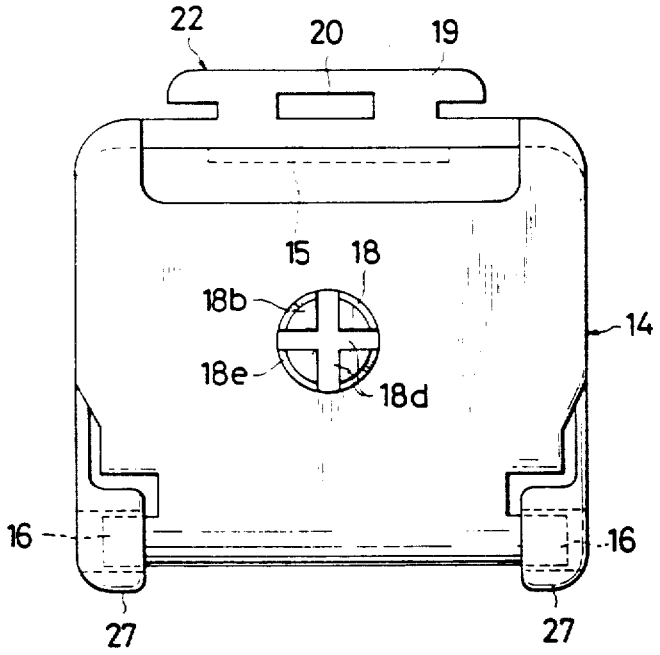
FIG. 4 is a rear view of FIG. 2.
Figure 5:
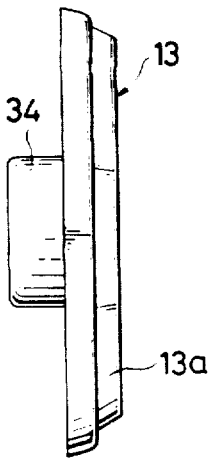
FIG. 5 is a side elevational view of a socket member constituting part of the strap fastener.

The plug 18, which extends laterally centrally from the base plate 14 in opposition to the locking prong 17, has a hollow cylindrical configuration and includes a stem portion 18*a* integral with the base plate 14 and an enlarged head portion 18*b* separated by an interrupted annular shoulder 18*c* from the stem portion 18*a*. The hollow cylindrical plug 18 further includes a plurality (four in the illustrated embodiment) of longitudinal slits 18*d* in a criss-cross formation, as better shown in FIG. 4, to render the plug 18 resilient and radially inwardly deformable. The head portion 18*b* has a tapered end 18*e*.

The base plate 14 and the cover plate 22 may be conveniently, though not exclusively, fabricated by injection-molding in assembled condition.

Figure 8:
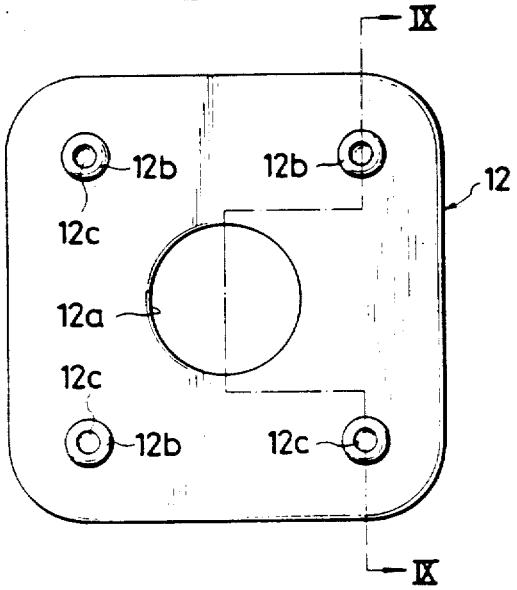
FIG. 8 is a front elevational view of a mounting plate constituting another part of the strap fastener.
Figure 9:
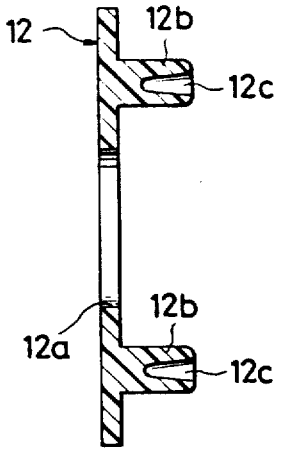
FIG. 9 is a cross-sectional view taken along line IX—IX of FIG. 8.

The mounting plate 12 to be interposed between the fastener body 11 and the socket member 13 is generally rectangular in shape and has a central aperture 12*a* for receiving a portion of the socket member 13 and a plurality of laterally extending anchoring posts 12*b* each with an axial blind hole 12*c*, there being four of these posts equally spaced around the central aperture 12*a* as better shown in FIG. 8.

Figure 6:
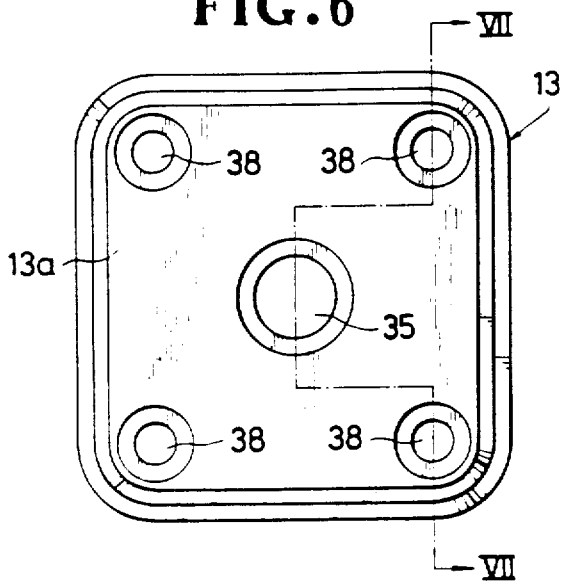
FIG. 6 is a front elevational view of the socket member.
Figure 7:
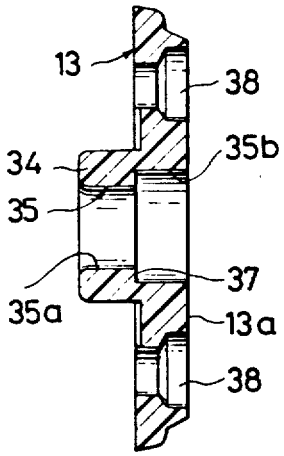
FIG. 7 is a cross-sectional view taken along line XII—XII of FIG. 6.

The socket member 13, which constitutes another part of the strap fastener 10, includes a substantially rectangular plate 13*a* and a cylindrical neck 34 extending centrally from the base plate 13*a*. The socket member 13 further has a stepped bore 35 extending through the base plate 13*a* and the neck 34. The stepped bore 35 is composed of a small-diameter portion 35*a* extending concentrically through the cylindrical neck 34, and a large-diameter portion 35*b* extending through the base plate 13*a*. The large- and small-diameter portions 35*b*, 35*a* are separated by an annular step 37 which is lockingly engageable with the interrupted annular shoulder 18*c* when the plug 18 is snapped in the stepped bore 35. The inside diameter of the small-diameter portion 35*a* is substantially the same as, preferably slightly larger than, the outside diameter of the cylindrical stem 18*a* of the plug 18. The outside diameter of the head 18*b* of the plug 18 is larger than the inside diameter of the small-diameter portion 35*a* and is smaller than the inside diameter of the larger-diameter portion 35*b*. As shown in FIG. 6, the socket 13 is provided with a plurality (four in number in this embodiment) of countersunk holes 38 a locations registering with the anchoring posts 12*b* of the mounting plate 12.

Figure 10:
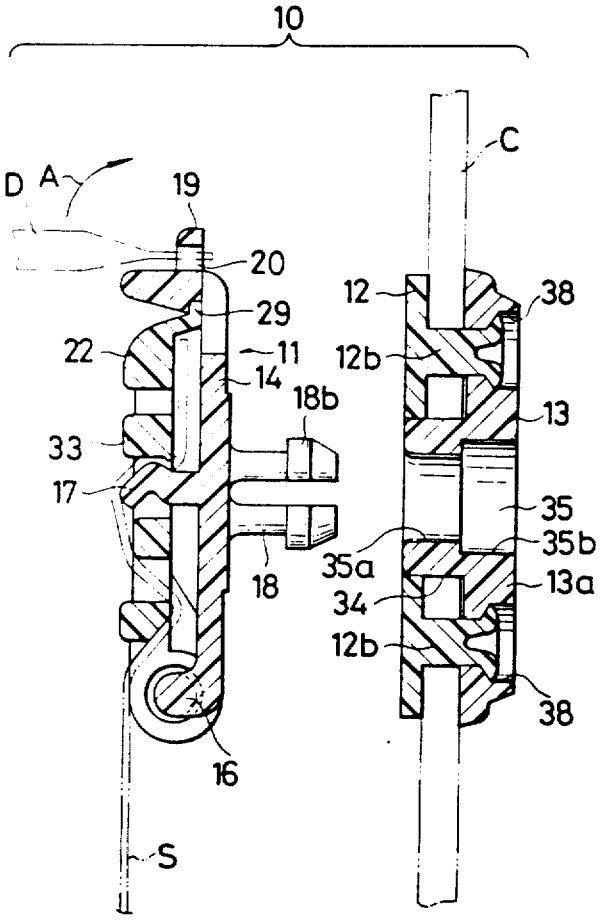
FIGS. 10 and 11 are cross-sectional views illustrative of the operation of the strap fastener of FIG. 1.

With this construction, the mounting plate 12 and the socket member 13 are first brought into coupling engagement with each other by inserting the neck 34 of the socket 13 into the central aperture 12*a* of the mounting plate 12 through an opening in a substrate such as sheet of fabric or leather C of a knapsack, with the anchoring posts 12*b* received in the corresponding holes 38. The lugs 12*b* may be plastically deformed by press or with heat to swell out and anchor within the countersunk holes 38, thereby joining the mounting plate 12 and the socket member 13 with the fabric sheet C sandwiched therebetween, as better shown in FIG. 10.

Figure 11:
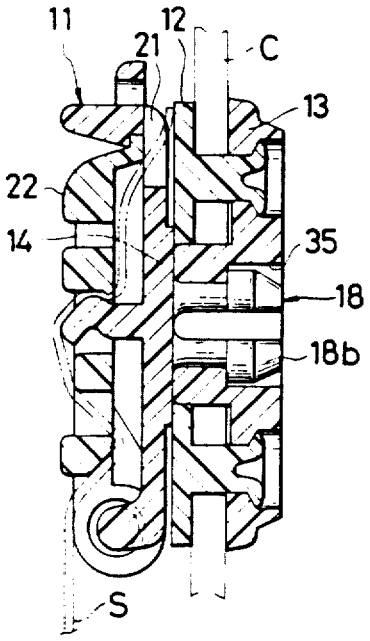

The fastener body 11 is then taken into coupling engagement with the socket member 13, which has been united with the mounting plate 12, by inserting the plug 18 into the stepped bore 35. As the head 18*b* of the plug 18 advances along the small-diameter portion 35*a* of the stepped bore 35, the head 18*b* is resiliently deformed radially inwardly. A further forward movement of the plug 18 causes the head 18*b* to be snapped into the large-diameter portion 35*b* due to the resiliency of the plug 18. In this instance, the interrupted annular shoulder 18*c* is held in interlocking engagement with the step 37 t hold the fastener body 11 and the socket member 13 in coupled condition, as shown in FIG. 11. The back of the fastener body 11 is held in contact with the face of the mounting plate 12.

The fastener body 11 can be rotated at will in either direction about an axis of the plug 18 relative to the socket member 13 so as to adjust the lateral position of the strap S on the knapsack to suit the particular physical characteristics of the user. In this instance, the fastener body 11 undergoes smaller frictional resistance imposed by the mounting plate 12 than by the fabric C of the knapsack.

The strap S can be also adjusted lengthwise by pulling its leading end in and out through the slot 21 in the base plate 14 of the fastener body 11, for which purpose and for removal or attachment of the strap S there may be used for example a screwdriver D (placed in the slit 20 in FIG. 10 and then tilted in the direction of the arrow A) with which to unlock or release the locking projection 29 from the recess 30.

Figure 12:
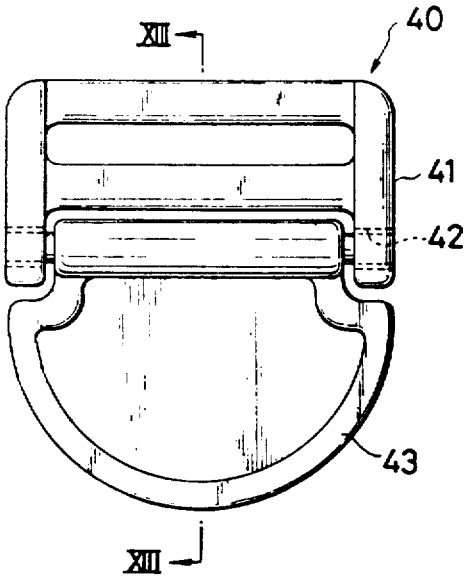
FIG. 12 is a front elevational view of a modified strap fastener according to the present invention.
Figure 13:
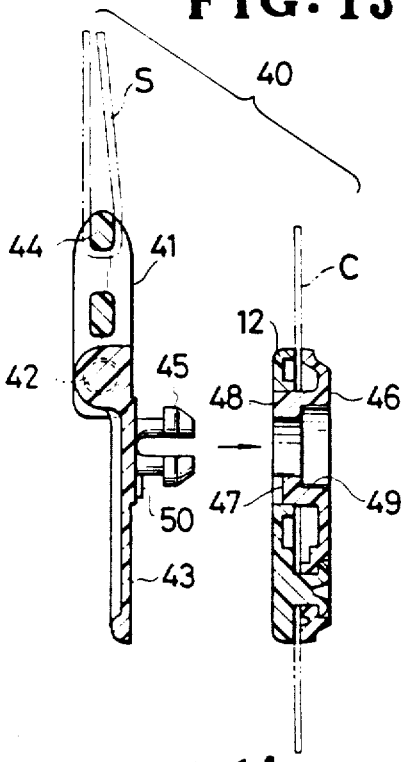
FIG. 13 is a cross-sectional view taken along line XIII—XIII of FIG 12.
Figure 14:
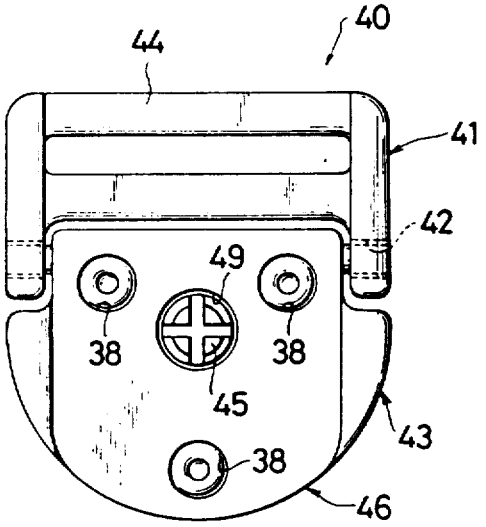
FIG. 14 is a rear view of FIG. 12.

FIGS. 12 through 14 show a modified form of strap fastener 40 which comprises a strap holder 41 pivotably connected at one end as at 42 to a base plate 43 and at the other end with a cross bar 44 around which is passed the strap S. The base plate 43 carries a plug 45 identical in construction and function with the plug 18 of FIG. 1 A socket member 46 of the strap fastener 40 is substantially the same as the socket member 13 of FIG. 1 with the exception that an elongate groove 47 extends arcuately in the face of a neck 48 to a limited angular extent about the axis of a stepped bore 49. When the plug 45 is snapped in the stepped bore 49, the groove 47 loosely receives a projection 50 on the back of the base plate 43. With the groove 47 and the projection 50 thus provided, the fastener body 41 is rotatable only within the limited angular extent with respect to the socket member 46 and hence the fabric C of a bag.

Figure 15:
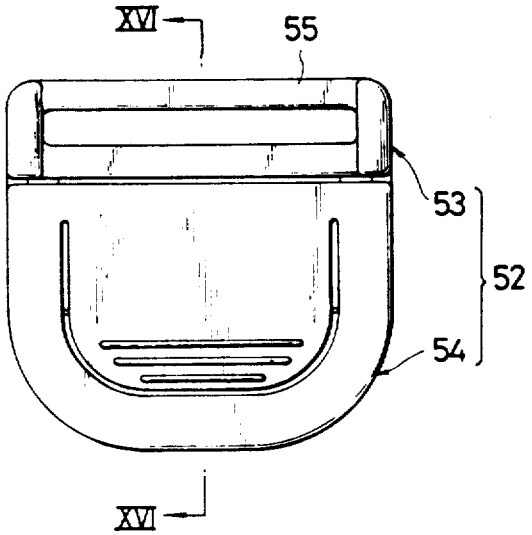
FIG. 15 is a front elevational view of another modified form of strap fastener.
Figure 16:
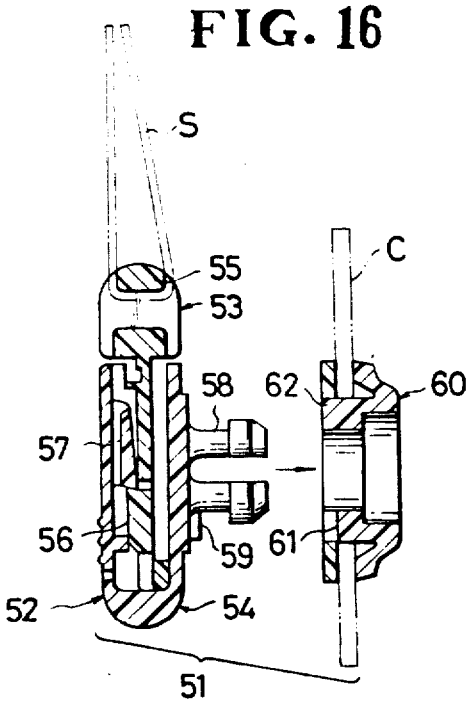
FIG. 16 is a cross-sectional view taken along line XVI—XVI of FIG. 15.
Figure 17:
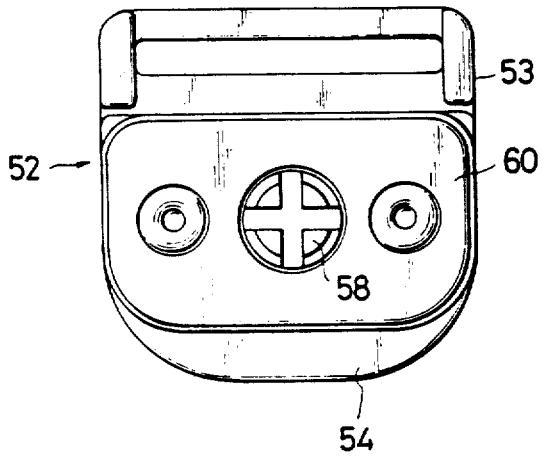
FIG. 17 is a rear view of FIG. 15.
Figure 18:
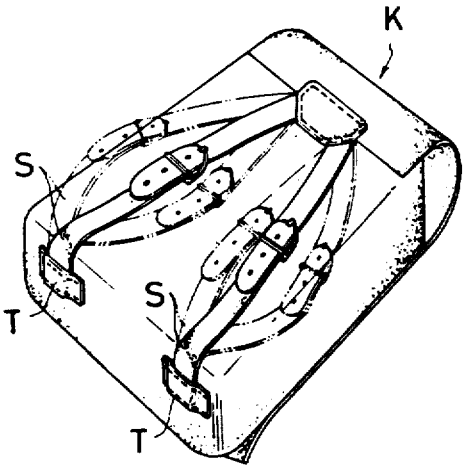
FIG. 18 PRIOR ART
FIG. 18 is a perspective view of a knapsack having straps secured in a manner known in the art.

FIGS. 15 through 17 show another modified form of strap fastener 51 which comprises a fastener body or buckle 52 composed of a male part 53 and a female part 54 releasably engageable with each other. The male part 53 has at one end a cross bar 55 for mounting the strap S and at the other end a hook 56 releasably engageable with a abutment strip 57 formed on the female part 54. The female part 54 includes a plug 58 extending from the back thereof and a projection 59 disposed adjacent to the plug 58. The plug 58 is identical in construction and function with the plug 45 of FIG. 13. When the plug 58 is snapped with a socket member 60, the projection 59 is received in an arcuately extending groove 61 in the face of a neck 62 of the of the socket member 60. The angular movement of the fastener body 52 relative to the socket member 60 is limited to a certain extent by engagement of the projection 59 with ends of the arcuate groove 61.

Many other modifications and changes may be made in the embodiments herein advanced, without departing from the scope of the appended claims. As for an example, the number of anchoring lugs **12*b* and openings 38 may be two or three as the case may be, or the lugs 12*b*** may be substituted by rivets.

What is claimed is:

1. A strap fastener for connecting a strap to the fabric of a bag, comprising:

a socket member adapted to be mounted on the fabric of the bag and having a stepped bore; and a fastener body having means for retaining the strap, and a plug projecting from the back of said fastener body, said plug including an enlarged head snappingly fittable in said stepped bore in said socket member to couple said fastener body with said socket member, said fastener body in coupled condition being rotatable about the axis of said plug with respect to said socket member;

said fastener body including a projection disposed on the back thereof, said socket member having an elongate groove receptive of said projecting and extending arcuately about the axis of said stepped bore to a limited angular extent.

2. A strap fastener for connecting a strap to the fabric of a bag, comprising:

a socket member adapted to be mounted on the fabric of the bag and having a stepped bore; and a fastener body having means for retaining the strap, and a plug projecting from the back of said fastener body, said plug including an enlarged head snapplingly fittable in said stepped bore in said socket member to couple said fastener body with said socket member, said fastener body in coupled condition being rotatable about the axis of said plug with respect to said socket member;

a mounting plate adapted to be disposed on the fabric of the bag opposite to said socket member for attaching said socket member to the fabric, said mounting plate having an aperture for the passage of said plug;

said socket member including a plate and a cylindrical neck projecting from said plate, said stepped bore extending coaxially through said neck, said neck being fittedly receivable in said aperture in said mounting plate; and said fastener body including a projection disposed on its back adjacent to said plug, said neck having an elongate groove receptive of said projection and extending arcuately about the axis of said stepped bore to a limited angular extent.

3. A strap fastener for connecting a strap to the fabric of a bag, comprising:

a socket member adapted to be mounted on the fabric of the bag and having a stepped bore; and a fastener body having means for retaining the strap, and a plug projecting from the back of said fastener body, said plug including an enlarged head snappingly fittable in said stepped bore in said socket member to couple said fastener body with said socket member, said fastener body in coupled condition being rotatable about the axis of said plug with respect to said socket member, said fastener body further including a base plate and a cover plate hinged to said base plate and releasably engageable with the base plate for holding the strap, said plug being disposed on the back of said base plate.

4. A strap fastener for connecting a strap to the fabric of a bag, comprising:

a socket member adapted to be mounted on the fabric of the bag and having a stepped bore; and a fastener body having means for retaining the strap, and a plug projecting from the back of said fastener body, said plug including an enlarged head snappingly fittable in said stepped bore in said socket member to couple said fastener body with said socket member, said fastener body in coupled condition being rotatable about the axis of said plug with respect to said socket member, said fastener body further including a base plate and a strap holder pivotably connected with said base plate and adapted to be connected with the strap, said plug being disposed on the back of said base plate.

5. A strap fastener for connecting a strap to the fabric of a bag, comprising:

a socket member adapted to be mounted on the fabric of the bag and having a stepped bore; and a fastener body having means for retaining the strap, and a plug projecting from the back of said fastener body, said plug including an enlarged head snappingly fittable in said stepped bore in said socket member to couple said fastener body with said socket member, said fastener body in coupled condition being rotatable about the axis of said plug with respect to said socket member, said fastener body comprising a buckle composed of a male part and a female part releasably engageable with said male part, said male part having a portion adapted to be connected to the strap, said plug being disposed on the back of said female part.

* * * * *